US010104952B2

(12) United States Patent
Choi

(10) Patent No.: US 10,104,952 B2
(45) Date of Patent: Oct. 23, 2018

(54) CAP FOR VESSEL OF COSMETICS

(71) Applicant: Jong-Suh Choi, Hwaseong-si (KR)

(72) Inventor: Jong-Suh Choi, Hwaseong-si (KR)

( * ) Notice: Subject to any disclaimer, the term of this patent is extended or adjusted under 35 U.S.C. 154(b) by 0 days.

(21) Appl. No.: 15/404,879

(22) Filed: Jan. 12, 2017

(65) Prior Publication Data

US 2017/0231365 A1 Aug. 17, 2017

(30) Foreign Application Priority Data

Feb. 12, 2016 (KR) ..... 10-2016-0016532

(51) Int. Cl.
*A45D 40/00* (2006.01)
*A45D 34/00* (2006.01)
*B05B 11/00* (2006.01)

(52) U.S. Cl.
CPC ..... *A45D 40/0075* (2013.01); *A45D 34/00* (2013.01); *B05B 11/001* (2013.01); *B05B 11/3001* (2013.01); *B05B 11/309* (2013.01); *B05B 11/3045* (2013.01)

(58) Field of Classification Search
CPC .. A45D 34/00; A45D 40/0075; B05B 11/309; B05B 11/3045
USPC ..... 141/23, 24, 26
See application file for complete search history.

(56) References Cited

U.S. PATENT DOCUMENTS 2,781,063 A * 2/1957 Williams ..... B01L 3/0282 141/24
3,101,751 A * 8/1963 Ballin ..... B01L 3/0282 141/24
4,579,153 A * 4/1986 Goncalves ..... B01L 3/0282 141/23
8,403,008 B2 * 3/2013 Bouix ..... A45D 34/04 141/23
9,089,868 B2 * 7/2015 Lee ..... A45D 34/04
2013/0074983 A1 * 3/2013 Choi ..... A45D 34/04 141/23
2013/0112314 A1 * 5/2013 Lee ..... A45D 34/04 141/23
2014/0234007 A1 * 8/2014 Lee ..... A45D 34/00 401/121

* cited by examiner

*Primary Examiner* — Timothy L Maust
(74) *Attorney, Agent, or Firm* — Novick, Kim & Lee, PLLC; Jae Youn Kim

(57) ABSTRACT

A vessel cap of cosmetics includes a coupling member formed on an inner circumferential surface thereof with a female screw part such that the female screw part is engaged with a male screw part formed on an outer circumferential surface of an opening formed in an upper portion of a vessel which receives liquid-phase contents, a spuit tube which is coupled to the coupling member to suck and discharge the contents received in the vessel, and a pumping unit of the spuit tube, which sucks the contents into the spuit tube after inserting the spuit tube into the vessel in a state that internal air of the spuit tube is partially discharged. The spuit tube is inserted into high-viscosity and liquid-phase contents received in the vessel after the internal air is discharged from the spuit tube, thereby previously preventing the discharged air from being introduced into the spuit tube.

6 Claims, 13 Drawing Sheets

CAP FOR VESSEL OF COSMETICS

BACKGROUND OF THE INVENTION

1. Field of the Invention

The present invention relates to a cap for a vessel of cosmetics, which includes a coupling member formed on an inner circumferential surface thereof with a female screw part so that the female screw part is engaged with a male screw part formed on an outer circumferential surface of an opening formed in an upper portion of the vessel which receives liquid-phase contents. More particularly, the present invention provides a cap for a vessel of cosmetics, in which a spuit tube is inserted into high-viscosity and liquid-phase contents received in the vessel after internal air is discharged from the spuit tube, thereby previously preventing the discharged air from being introduced into the spuit tube from the high-viscosity and liquid-phase contents, so that the high-viscosity and liquid-phase contents can be sucked into the spuit tube in a required amount.

2. Description of the Related Art

In general, a spuit is a distribution unit to suck a liquid-phase material and discharge the liquid-phase material from the spuit to a required part through an exhaust or suction action generated in a pumping action. As a tube-type pumping part having excellent elastic force and a reversed U shape is compressed, air is discharged from an inner part of a spuit tube coupled to a lower end of the pumping part. When elastic restoring force is generated after the pumping part is compressed, air or liquid-phase contents are sucked into the spuit tube. Then, as the pumping part is re-compressed, the liquid-phase contents are discharged.

In order to suck and discharge the liquid-phase contents contained in the vessel, the spuit tube is introduced into the contents of the vessel, and the pumping part is compressed to discharge the air from the inner part of the spuit. Then, as the pumping part is compressed and the compressive force of the pumping part is released, the liquid-phase contents received in the vessel are sucked into the spuit tube using the elastic restoring force of the pumping part and the contents sucked into the spuit tube are discharged to a position desired by the user, so that the user can use the liquid-phase contents in a required amount.

In this case, since the contents received in the vessel represent lower viscosity and excellent flowability when the air is discharged from the inner part of the spuit tube, the air discharged from the spuit tube makes bubbles in the contents and rapidly floats, and the liquid-phase contents approach an opening formed in a lower end of the spuit tube, so that the contents may be sucked into the spuit tube in a suction action.

However, as shown in FIG. 1, when the liquid-phase contents received in a vessel 1 as shown in FIG. 1 represent higher viscosity, the flowability of the contents is reduced. Accordingly, when a pumping part 3 is compressed to discharge air from the inner part of a spuit tube 2 in the state that the spuit tube 2 is introduced into the liquid-phase contents, and the discharged air does not float after forming an air layer in the liquid-phase contents, but stays around a discharge hole 2*a* in a lower end of the spuit tube 2 while significantly slowly ascends.

Accordingly, when the user compresses the pumping part 3 and immediately releases the compressive force applied to the pumping part 3, the air in the air layer staying around the discharge hole 2*a* in the lower end of the spuit tube 2 is sucked into the discharge hole 2*a* in the lower end of the spuit tube 2, so that the liquid-phase contents may not be smoothly sucked in a sufficient amount.

SUMMARY OF THE INVENTION

Accordingly, the present invention has been made keeping in mind the above problems occurring in the prior art, and an object of the present invention is to provide a cap for a vessel of cosmetics, capable of sucking high-viscosity and liquid-phase contents without an influence of discharged air as the air is discharged from an inner part of a spuit tube outside the high-viscosity and liquid-phase contents, and the spuit tube is inserted into the contents and sucks the contents.

In order to accomplish the object, there is provided a cap for a vessel of cosmetics including a coupling member (210) formed on an inner circumferential surface thereof with a female screw part (212) engaged with a male screw part (102*a*) formed on an outer circumferential surface of an opening (102) formed in an upper portion of the vessel (100) that receives liquid-phase content, a spuit tube (220) coupled to the coupling member (210) to suck and discharge the contents received in the vessel (100), a pumping unit of the spuit tube (220) to suck the contents into the spuit tube (220) after inserting the spuit tube (220) into the vessel (100) in a state that internal air of the spuit tube (220) is partially discharged.

The pumping unit of the spuit tube (220) includes a cylinder (214) which has an open upper portion and protrudes from an upper end of the coupling member (210), a through hole (216) which allows the cylinder (214) to vertically communicate with a lower portion having the female screw part (212), a lower piston (230) which is inserted into the cylinder (214) such that that an outer circumferential surface of the lower piston (230) closely makes contact with an inner circumferential surface of the cylinder (214), and has a coupling hole (232) vertically formed therein and a coupling groove (234) formed around a lower inner circumferential surface thereof such that a coupling protrusion (222) from an upper end of the spuit tube 220, which passes through the through hole (216) upward, is inserted into the coupling groove (234), an upper piston (240) which is spaced apart from the lower piston (230) by a predetermined distance and inserted into the cylinder (214) such that an outer circumferential surface of the upper piston (240) closely makes contact with the inner circumferential surface of the cylinder (214), a pressing member (250) which is inserted into an outer portion of an upper end of the cylinder (214) and has a coupling part (252) formed on a bottom surface thereof and coupled to an upper end of the upper piston (240), an elastic member (260) which is inserted into an outer portion of the cylinder (214) to be securely mounted on a mounting part (218) formed in one of the upper end of the coupling member (210) and a lower outer portion of the cylinder (214), and elastically supports a lower portion of the pressing member (250) to apply elastic force upward, a cover member (270) which is down-inserted into an outer portion of the pressing member (250) to be coupled to an outer circumferential surface of the coupling member (210), and has a narrower upper portion and a wider lower portion to prevent the pressing member (250) and the elastic member (260) from being separating from the cover member (270), and a stop maintaining member (280) for the spuit tube, which temporarily stops the spuit tube (220) down-inserted into the opening (102) of the vessel (100), and maintains the spuit tube (220) in a stopped state.

The stop maintaining member (280) of the spuit tube includes a stopper (282) which is coupled to an upper end of the vessel (100), and formed therein with a stop hole (282*a*) such that the spuit tube (220) is down-inserted into the stop hole (282*a*) in a press-fitting manner.

The stop maintaining member (280) of the spuit tube includes a stopper (282) which is coupled to an upper end of the vessel (100), and formed therein with a stop hole (282*a*) having a wider upper portion and a narrower lower portion such that the spuit tube (220) is down-inserted into the stop hole (282*a*) in a press-fitting manner.

The stop maintaining member (280) of the spuit tube includes a stopper (282) which is coupled to an upper end of the vessel (100), and formed therein with an insertion hole (282*b*) such that the spuit tube (220) is inserted into the insertion hole (282*b*) and at least one first stop protrusion (282*c*) protruding from an inner circumferential surface of the insertion hole (282*b*) such that the spuit tube (220) is down-inserted in a press-fitting manner.

The cap of claim 2, wherein the stop maintaining member (280) of the spuit tube includes: a stopper (282) which is coupled to an upper end of the vessel (100), and formed therein with an insertion hole (282*b*) such that the spuit tube (220) is inserted into the insertion hole (282*b*), and at least one second stop protrusion (224) protruding from an outer circumferential surface of the spuit tube (220) such that the spuit tube (220) is down-inserted into the insertion hole (282*b*) in a press-fitting manner.

The stop maintaining member (280) of the spuit tube includes a stopper (282) which is coupled to an upper end of the vessel (100), and formed therein with a stop hole (282*a*) such that the spuit tube (220) is inserted into the stop hole (282*a*). An outer portion of the spuit tube (220) is formed in multiple steps such that the spuit tube (220) is down-inserted into an insertion hole (282*b*) in a press-fitting manner, an insertion part (2260) is formed to a predetermined distance of a lower portion of the spuit tube (220) and has an outer diameter smaller than a diameter of the insertion hole (282*b*), and a fitting part (228) is formed above the insertion part (226) such that the fitting part (228) is press-fitted into the insertion hole (282*b*).

As described above, when the spuit tube inserted into the opening of the vessel is temporarily stopped and maintained to partially discharge internal air. In this state, the spuit tube is inserted into the vessel, so that contents are sucked into the spuit tube as soon as the pressing member ascends. Accordingly, the high-viscosity and liquid-phase contents received in the vessel can be pumped without disturbance. Accordingly, the user can use the contents by performing convenient and safe pumping operations.

DETAILED DESCRIPTION OF THE INVENTION

Figure 1:
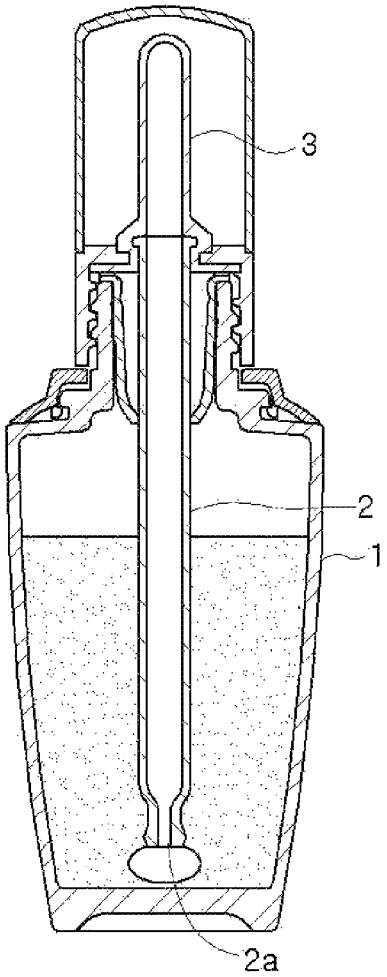
FIG. 1 PRIOR ART
FIG. 1 is a view showing the state that air is discharged into high-viscosity and liquid-phase contents from a spuit tube and stays in the high-viscosity and liquid-phase contents according to the related art.
Figure 2:
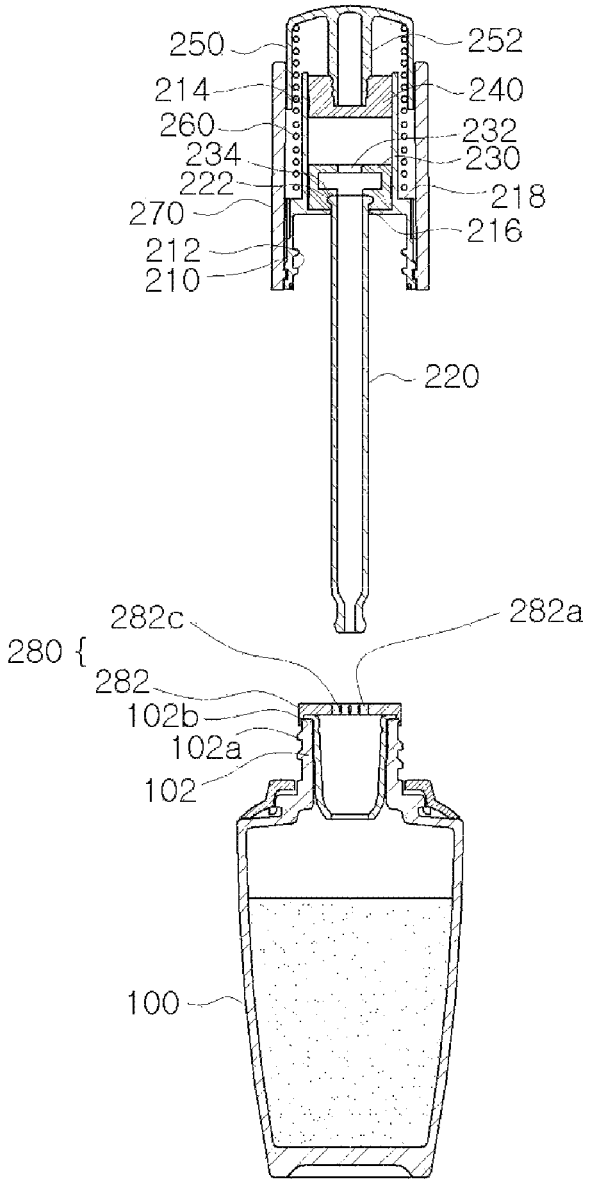
FIG. 2 is a view showing the structure according to a first embodiment of the present invention.
Figure 3A:
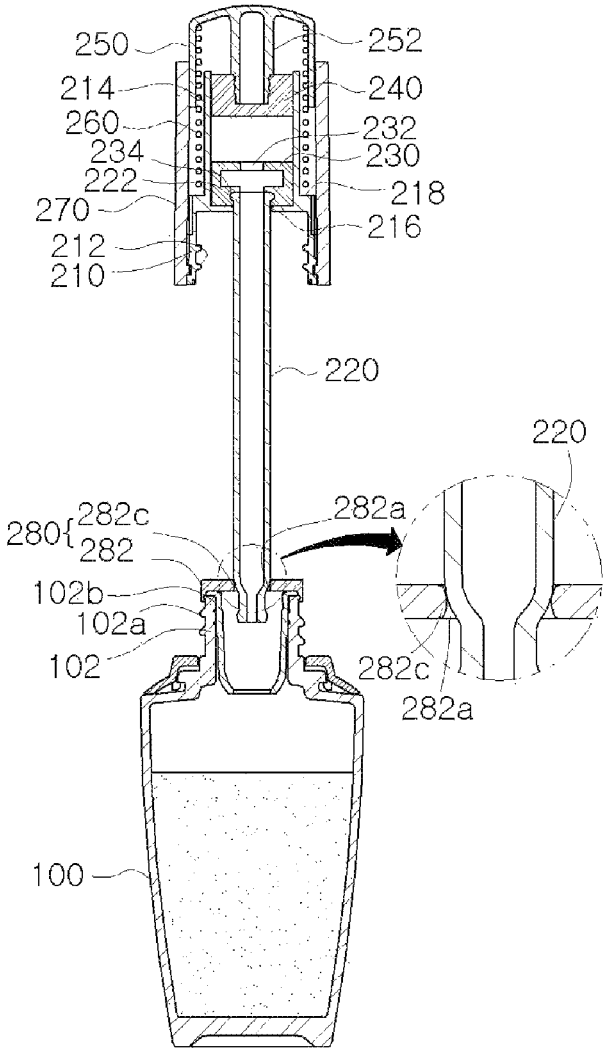
FIGS. 3A to 3E are views showing the operating states according to the embodiment of the present invention.
Figure 3B:
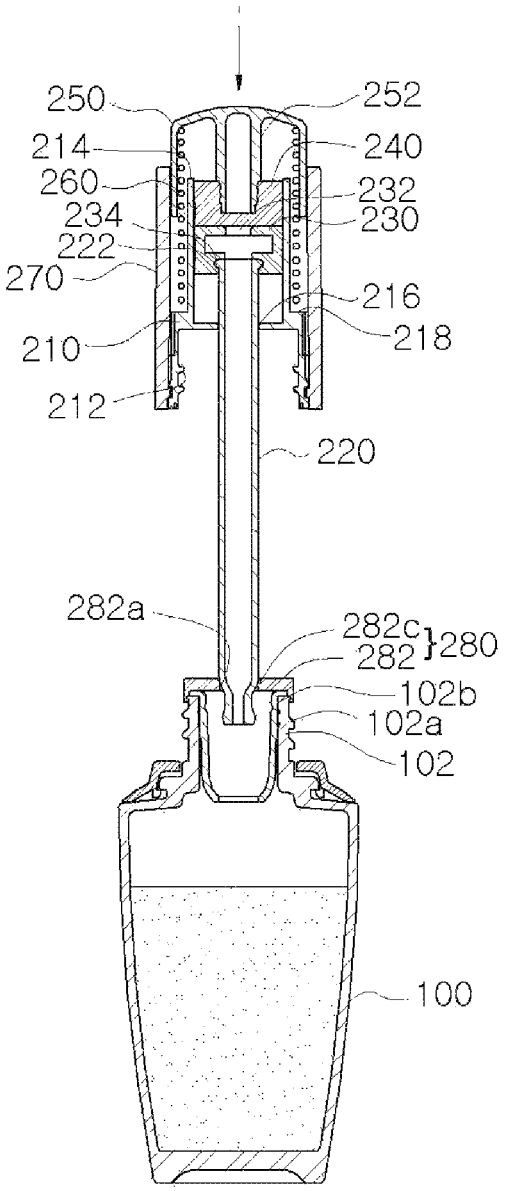
Figure 3C:
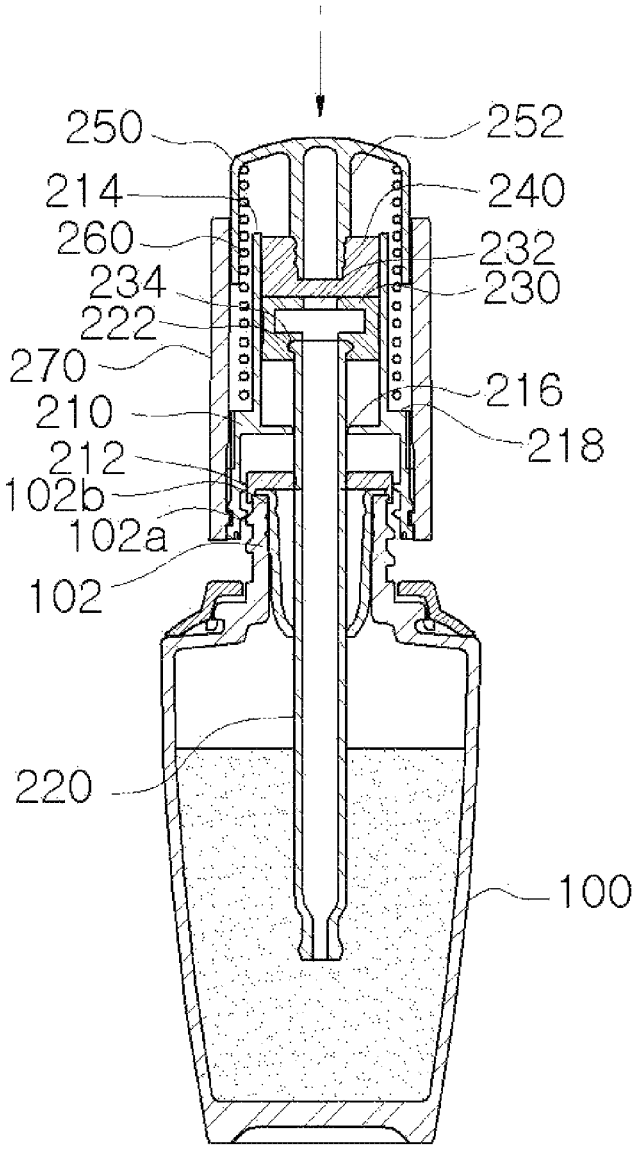
Figure 3D:
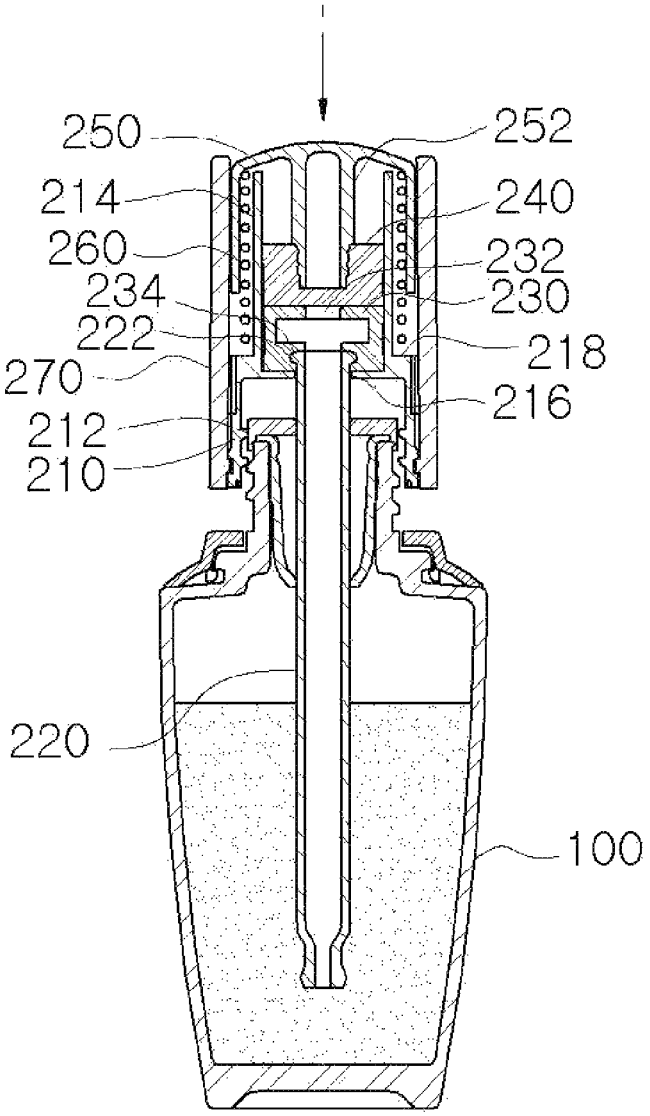
Figure 3E:
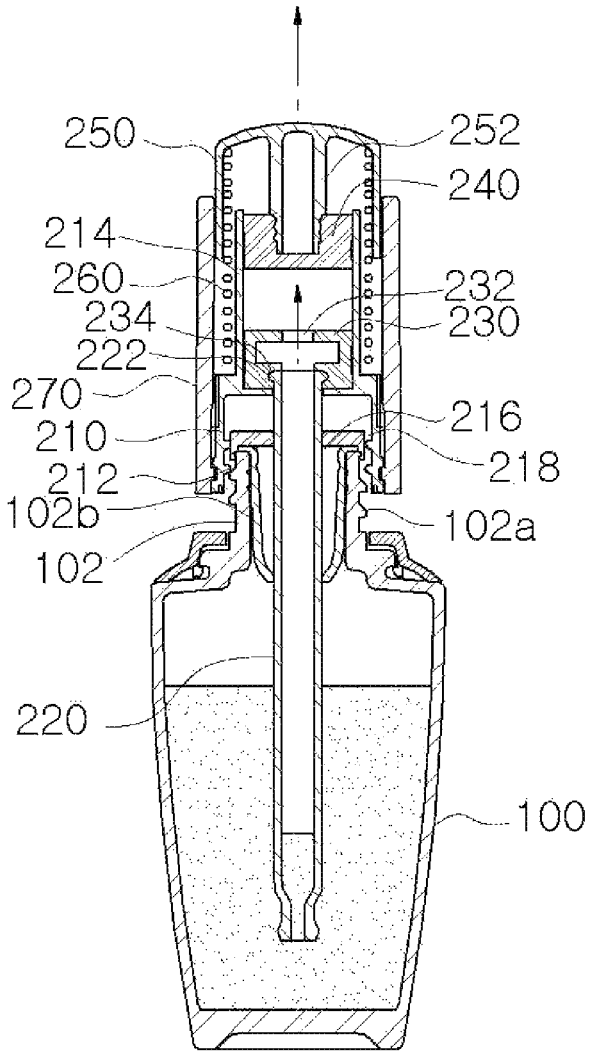
Figure 4:
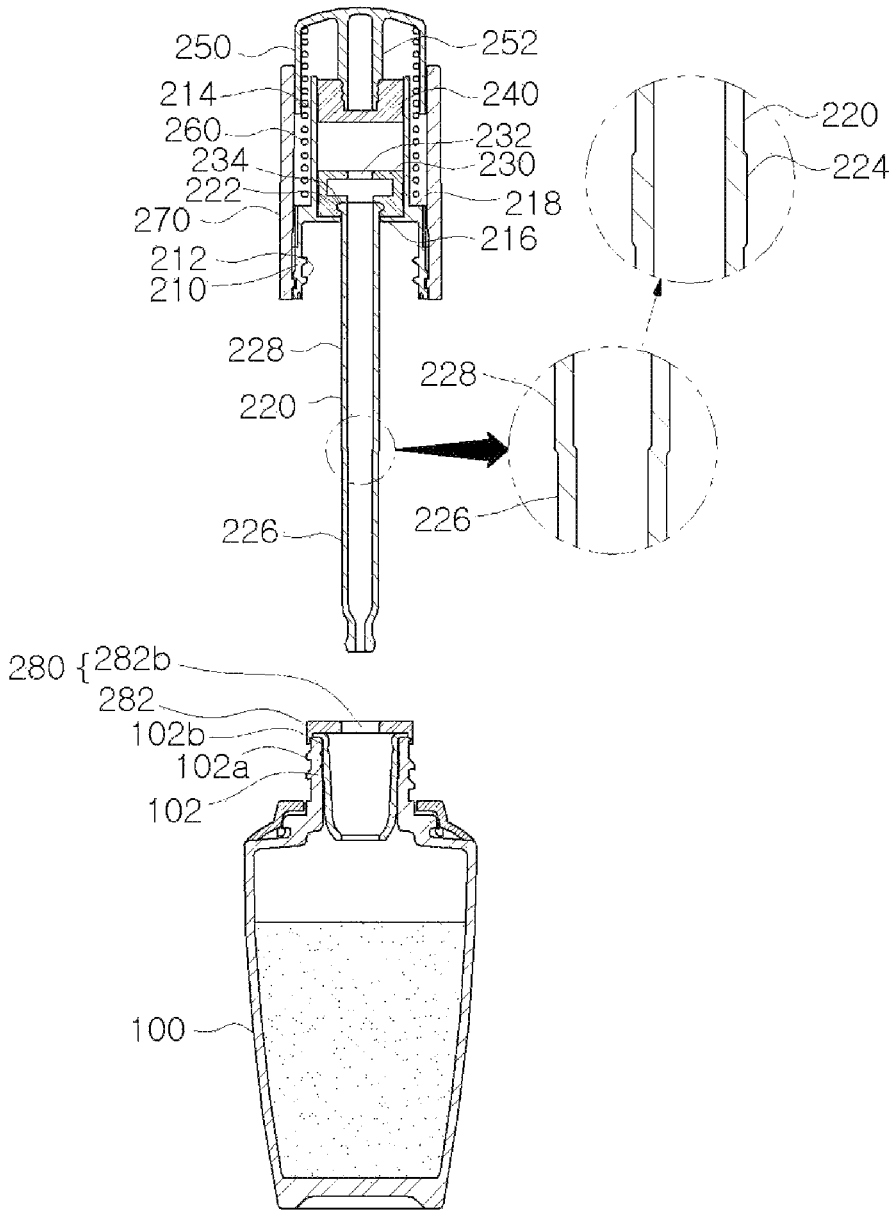
FIG. 4 is a view showing the structure according to a second embodiment of the present invention.

Structures and operations of the present invention will be described with reference to FIGS. 2 to 5E. FIGS. 2 to 3E show a first embodiment, and FIGS. 4 to 5E show a second embodiment. In the following description, the structure and the operation according to each embodiment will be described.

First, the common structure of a cap for a vessel of cosmetics according to the present invention will be first described, and then mutually different structures and operations according to the first and second embodiments will be described.

Common Structures in First and Second Embodiments

A male screw part 102*a* is formed at an opening 102 in an upper end of a vessel 100 of cosmetics, and a female screw part 212 is formed on an inner circumferential surface of a lower portion of a coupling member 210 so that the male screw part 102*a* is coupled to the female screw part 212.

In addition, the spuit tube 220, which has a tubular structure, is inserted into an upper opening hole 102*b* formed in the opening 102 of the vessel 100, which receives high-viscosity and liquid-phase contents to suck the liquid-phase contents. As shown in FIG. 2, the spuit tube 220 has a coupling protrusion 222 protruding from an upper outer portion of the spuit tube 220 in a circumferential direction.

According to the present invention, a pumping unit of the spuit tube 220 is provided to discharge internal air of the spuit tube 220 when the spuit tube 220 is inserted into the vessel 100 through the opening hole 102*b* in the opening 102*b*, and to suck the contents in the vessel 100.

As shown in FIG. 2, in the pumping unit of the spuit tube 220, the spuit tube 220 is coupled to the coupling member 210, the spuit tube 220 is inserted into the opening hole 102*b* in the opening 102, the insertion operation of the spuit tube 220 is stopped and maintained at a specific location, such as a lower end or an intermediate part of the spuit tube 220 to discharge the internal air of the spuit tube 220, and the spuit tube 220 is re-inserted into the vessel 100 through the opening hole 102*b* to suck the contents.

In other words, in the pumping unit of the spuit tube 220, a cylinder 214 having an open upper portion protrudes from an upper end of the coupling member 210, a through hole 216 is vertically formed so that the floor of the cylinder 214 communicates with an inner portion of the female screw part 212, the upper end of the spuit tube 220, that is, the coupling protrusion 222 is inserted upward from the lower portion of the through hole 216.

In addition, as shown in FIG. 2, a lower piston 230 is inserted into the cylinder 214 in such a manner that an outer circumferential surface of the lower piston 230 slides in a close contact state with an inner circumferential surface of the cylinder 214. A coupling hole 232 is formed in the lower piston 230 in a vertical direction, and a coupling groove 234 is formed around a lower inner circumferential surface of the coupling hole 232 so that the coupling protrusion 222 of the spuit tube 220 is inserted into the coupling groove 234 to form a coupling structure.

As shown in FIG. 2, a upper piston 240 is inserted into the cylinder 214, that is, an upper portion of the lower piston 230 in such a manner that an outer circumferential surface of the upper piston 240 slides in the close contact with an inner circumferential surface of the cylinder 214 similarly to the lower piston 230.

In addition, a pressing member 250 is covered on an upper outer portion of the cylinder 214 in such a manner that a coupling part 252 formed on a bottom surface of the pressing member 250 is coupled to the upper piston 240. Accordingly, if the pressing member 250 is pressed down, the upper piston 240 may slide down in the close contact state with an inner circumferential surface of the cylinder 214.

Further, as shown in FIG. 2, a mounting part 218 is formed in any one of an upper end of the coupling member 210 and a lower outer portion of the cylinder 214. An elastic member 260, which is fitted around the outer portion of the cylinder 214, is securely mounted in the mounting part 218, and the upper end of the elastic member 260 elastically supports the pressing member 250. Accordingly, after the pressing member 250 presses down the upper piston 240 while descending, the pressing member 250 and the upper piston 240 may ascend by elastic force of the elastic member 260.

A cover member 270 is down-fitted around the outer portion of the pressing member 250 and coupled to an outer circumferential surface of the coupling member 210.

In this case, the cover member 270 has an upper inner portion narrower than a lower inner portion, and the pressing member 250 has a lower outer portion wider than an upper outer portion. Accordingly, preferably, the cover member 270 is closely brought contact with the lower outer portion of the 250 to prevent the pressing member 250 from being separated from the cover member 270, and the coupling member 210 and the elastic member 260 mounted on the pressing member 250 can be maintained in an elastic installation state by the pressing member 250 and the cover member 270.

As described above, the first embodiment to the fifth embodiment of the cap for the vessel of cosmetics according to the present invention have a common structure of the coupling member 210 coupled to the vessel 100, the cylinder 214 and the spuit tube 220 formed at the upper portion of the coupling member 210, the lower piston 230, the upper piston 240, the pressing member 250, the elastic member 260, and the cover member 270, except for the design of a stop maintaining member 280 of the spuit tube which is to be described below. Hereinafter, the structure and the operation of the stop maintaining member 280 of the spuit tube will be described.

First Embodiment of Stop Maintaining Member 280 of Spuit Tube

A stopper 282 is coupled to an upper end of the opening 102 of the vessel 100, and a stop hole 282*a* is vertically formed through the stopper 282. Accordingly, when the spuit tube 220 is down-inserted, the spuit tube 220 is down-inserted in a press-fitting manner. In this case, an inner diameter of the stop hole 282*a* is formed to be equal to or greater than an outer diameter of the spuit tube 220, so that the spuit tube 220 is press-fitted into the stop hole 282*a*. In addition, if a user additionally applies pressure to the pressing member 250 so that predetermined force is added to force to down-insert the spuit tube 220, the spuit tube 220 starts to be down-inserted into the stop hole 282*a* while passing through the stop hole 282*a*.

Second Embodiment of Stop Maintaining Member 280 of Spuit Tube

Although the second embodiment has the same configuration as that of the first embodiment, the inner sectional surface of the stop hole 282*a* is formed in a structure that an upper portion is wide and a lower portion is narrow, so that only the lower portion of the stop hole 282*a* is closely fitted around the outer portion of the spuit tube 220.

Third Embodiment of Stop Maintaining Member 280 of Spuit Tube

As shown in FIG. 2, the stopper 282 is coupled to the upper end of the opening 102 of the vessel 100. The stopper 282 is formed therein with an insertion hole 282*b* so that the spuit tube 220 is inserted into the insertion hole 282*b* and passes through the insertion hole 282*b*. At least one first stop protrusion 282 protrudes from an inner circumferential surface of the insertion hole 282*b* so that an outer circumferential surface of the spuit tube 220 closely interferes with the inner circumferential surface of the insertion hole 282*b* in a press-fitting manner.

Fourth Embodiment of Stop Maintaining Member 280 of Spuit Tube

The stopper 282, which is formed therein with the insertion hole 282*b* so that the spuit tube 220 is inserted into the insertion hole 282*b* and passes through the insertion hole 282*b*, is coupled to the upper end of the opening 102 of the vessel 100. As shown in FIG. 5, at least one second stop protrusion 224 protrudes from the outer circumferential surface of the spuit tube 220 so that the second stop protrusion 224 closely interferes with the inner circumferential surface of the insertion hole 282*b* in a press-fitting manner.

Fifth Embodiment of Stop Maintaining Member 280 of Spuit Tube

The stopper 282, which is formed therein with the insertion hole 282*b*, is coupled to the upper end of the opening 102 of the vessel 100 similarly to that of the fourth embodiment, and the outer circumferential surface of the spuit tube 220 is formed in multiple steps as shown in FIG. 5.

In other words, as shown in FIG. 5, an insertion part 220 is formed to a predetermined distance from a lower end of the spuit tube 220 and has an outer diameter narrower than a diameter of the insertion hole 282*b* so that the spuit tube 220 may freely pass through the insertion hole 282*b*. A fitting part 228 is formed above the insertion part 226 in the spuit tube 220 and has an outer diameter equal to or greater than the diameter of the inner circumferential surface of the insertion hole 282*b* so that only the fitting part 228 is inserted into the insertion hole 282*b* and passes through the insertion hole 282*b* in a press-fitting manner.

Hereinafter, the operation of the cap for the vessel of cosmetics according to the present invention having the above configuration will be described with reference to FIGS. 2 to 5E.

FIGS. 2 to 3E show the third embodiment of the present invention. Since the first and second embodiments are substantially identical to that of the third embodiment in description, the details of the first and second embodiments will be omitted, and only the third embodiment will be representatively described below.

FIG. 2 shows the spuit tube 220 before the spuit tube 220 is inserted into the stop hole 282*a* of the stopper 282 coupled to the opening 102 in an initial stage. When a user inserts the spuit tube 220 into the stop hole 282*a* in the state of grasping the pressing member 250 and the 290*c* in a hand of the user, the outer circumferential surface of the spuit tube 220 interferes with a first stop protrusion 282*c* protruding the inner circumferential surface of the stop hole 282*a*, so that the insertion operation of the spuit tube 220 is temporarily stopped and maintained.

In this case, if the user additionally presses down the pressing member 250, since the pressing member 250 is pressed down in the state that the spuit tube 220 is stopped and maintained, the cylinder 214, the coupling member 210, the pressing member 250, and the cover member 270 descend in the state that the inner circumferential surface of the cylinder 214 closely makes contact with the outer portion of the lower piston 230. Accordingly, as shown in FIG. 3B, the lower surface of the upper piston 240 makes contact with the top surface of the lower piston 230, so that air is discharged from the inner part of the spuit tube 220.

In this case, if the user additionally presses down the pressing member 250, the coupling part 252 of the pressing member 250 makes contact with the upper piston 240 and the lower piston, and the upper end of the spuit tube 220 is coupled to the lower piston 230. Accordingly, since force to press the pressing member 250 is applied to the spuit tube 220 without change, the spuit tube 220 stopped and maintained by the stopper 282 ascends in the press-fitting manner with the first stop protrusion 282*c* as shown in FIG. 3C. In this case, the coupling member 210 is stopped and maintained by the opening 102, so that the descending operation of the spuit tube 220 is stopped.

If the user more strongly presses the pressing member 250, since the coupling member 210 interferes with the opening 102, the pressing member 250 compresses the elastic member 260 while the upper piston 240 and the lower piston descending in the cylinder 214.

In this case, as shown in FIG. 3C, the air layer formed at a lower portion of the lower piston 230 is discharged through a through hole 216 of the coupling member 210.

If the force to press the pressing member 250 is released after the spuit tube 220 is inserted into the vessel 100 as described above, since the spuit tube 220 is stopped and maintained in the press-fitting manner with the first stop protrusion 282*c*, only the pressing member 250 ascends by the elastic restoring force of the elastic member 260. In this case, the upper piston 240 ascends together, so that the contents in the vessel 100 of cosmetics may be sucked into the spuit tube 220.

Accordingly, as the user grasps the cover member 270 and then lifts up the spuit tube 220, thereby separating the spuit tube 220 from the stopper hole 282*a*. Then, the user presses down the pressing member 250 again to discharge the contents from the inner part of the spuit tube 220 and to use the contents.

In the first and second embodiments, the stop hole 282*a* is press fitted with the spuit tube 220 in the state that only the first stop protrusion 282 is not formed. Accordingly, the descriptions of the operations in the first and second embodiments will be substituted with the description of the operation in the third embodiment.

Meanwhile, FIG. 4 shows the fourth and fifth embodiments of the present invention. The fifth embodiment is shown in FIGS. 4 to 5E, and the description of the operation in the fourth embodiment will be substituted with the operation of the structure of the second stop protrusion 224 protruding from the outer portion of the spuit tube 220 of FIG. 4.

According to the fifth embodiment, as shown in FIG. 4, the outer portion of the spuit tube 220 is designed in multiple steps. The size of the lower diameter of the spuit is formed to be smaller than the diameter of the insertion hole 282*b* to form the insertion part 226, so that the spuit tube 220 may be freely inserted into the insertion hole 282*b* or separated from the insertion hole 282*b*. The fitting part 228 is formed above the insertion part 226 of the spuit tube 220 to have the outer diameter equal to or larger than the inner diameter of the insertion hole 282*b* so that the spuit tube 220 interferes with the insertion hole 282*b* of the stopper 22 in the press-fitting manner.

Figure 5A:
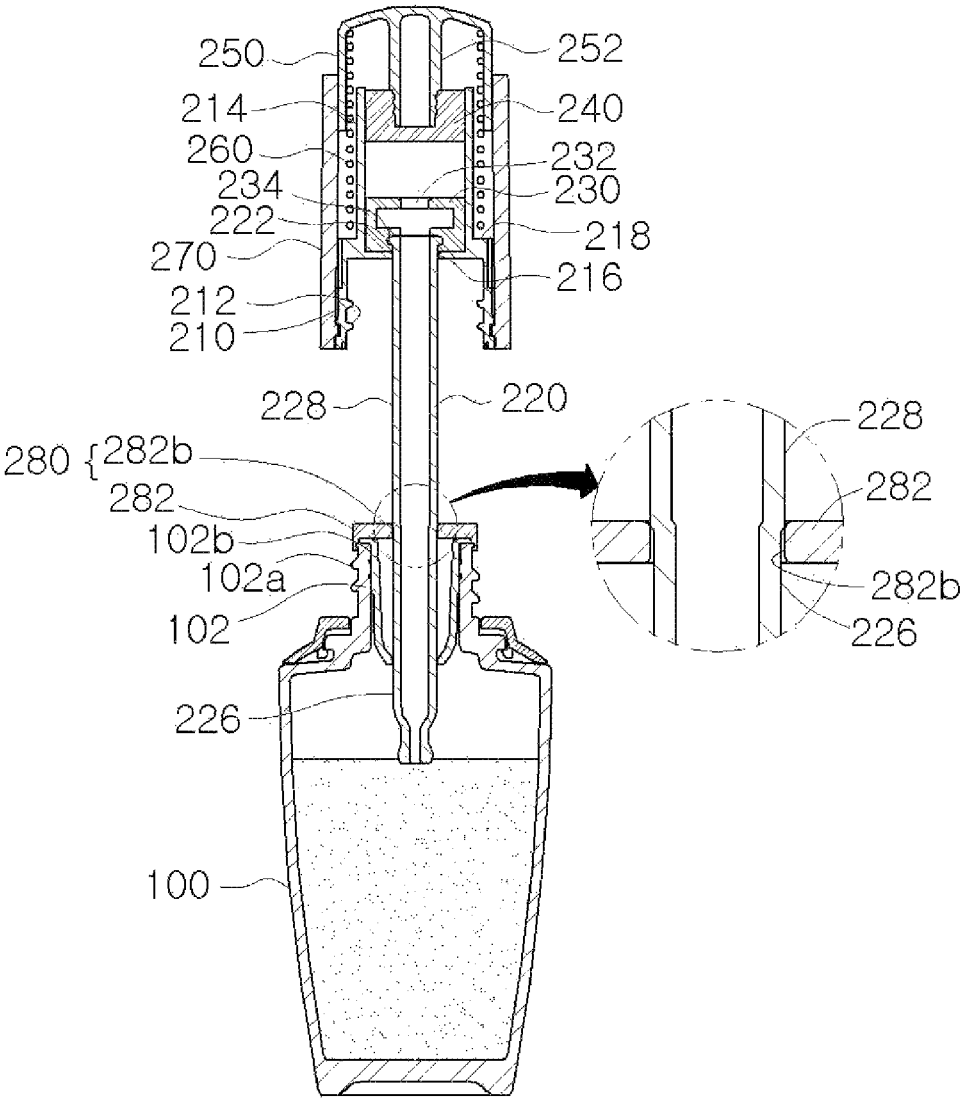
FIGS. 5A to 5E are views showing the operating states according to the second embodiment of the present invention.

Accordingly, if the spuit tube 220 is inserted into the insertion hole 282*b*, the insertion part 226 is freely inserted into the insertion hole 282*b* without interference with the insertion hole 282*b* as shown in FIG. 5A, the fitting part 228 formed above the insertion part 226 interferes with the insertion hole 282*b*, so that the fitting part 228 is stopped and maintained as shown in FIG. 5A.

Figure 5B:
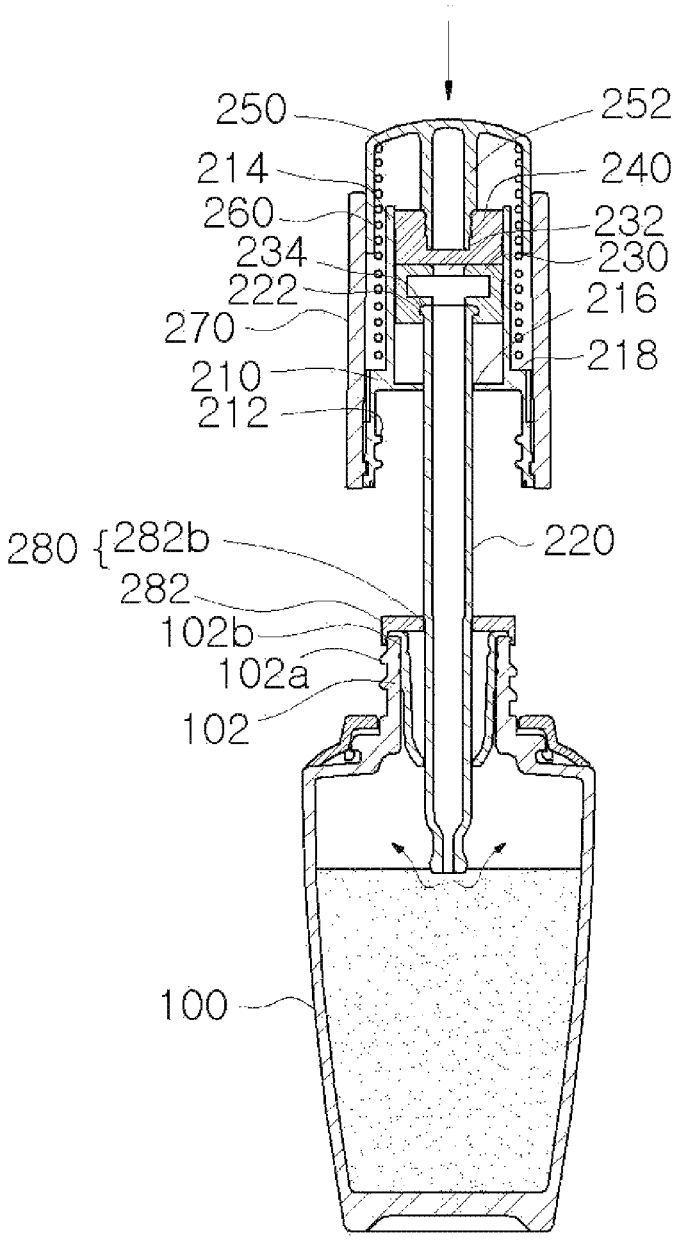

In this case, if the user additionally presses down the pressing member 250, the cylinder 214 descends in the state that the inner circumferential surface of the cylinder 214 closely makes contact with the outer circumferential surface of the lower piston 230. Accordingly, the upper surface of the lower piston 230 closely makes contact with the lower surface of the piston 240 as shown in FIG. 5B, so that the air is discharged from the inner part of the spuit tube 220.

Figure 5C:
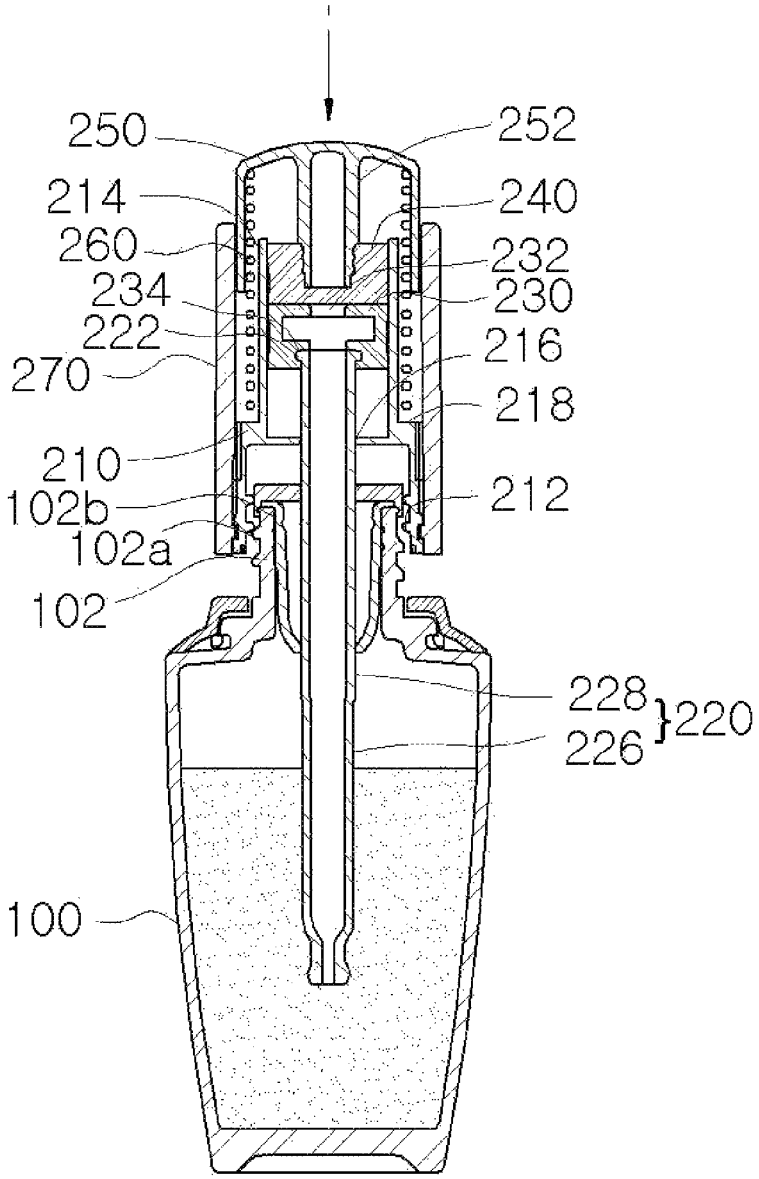

In addition, if the user additionally presses down the pressing member 250, since the coupling part 252 of the pressing member 250 is coupled to the upper piston 240, the lower piston 230 closely makes contact with the upper piston 240, and the upper end of the spuit tube 220 is coupled to the lower piston 230, the spuit tube 220 descends until the coupling member 210 interferes with the opening 102 as shown in FIG. 5C in the state that the fitting part 228 of the spuit tube 220 is press-fitted into the insertion hole 282*b*.

Figure 5D:
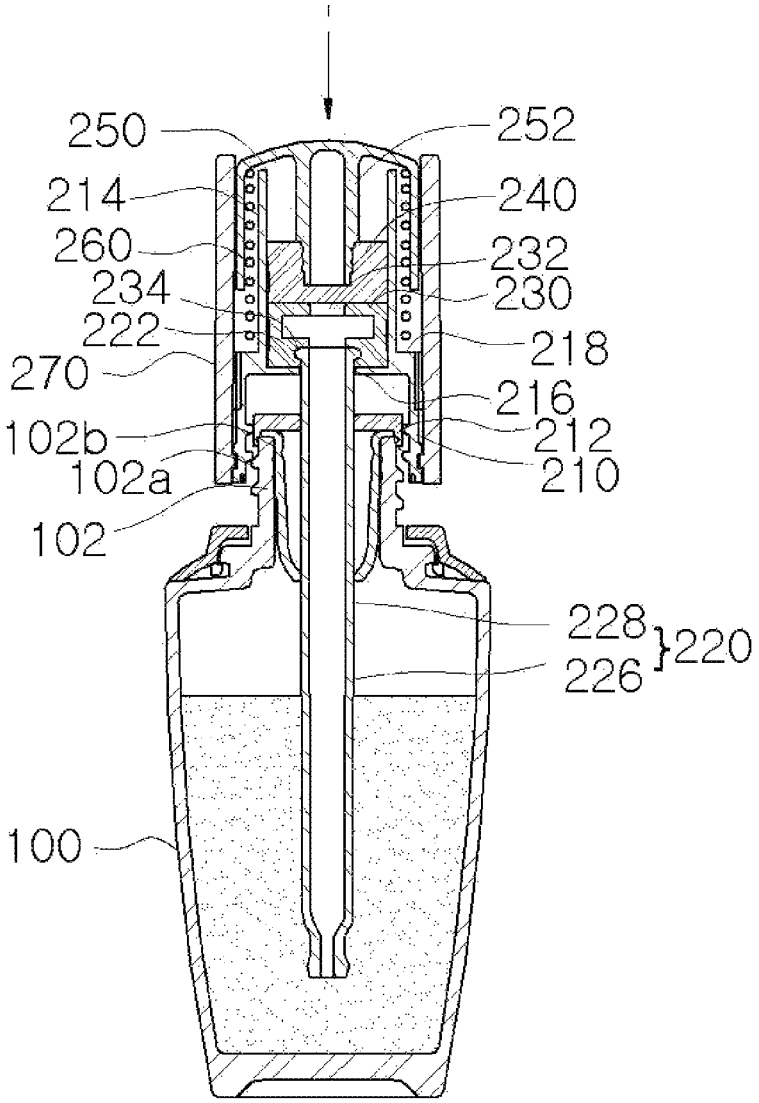
Figure 5E:
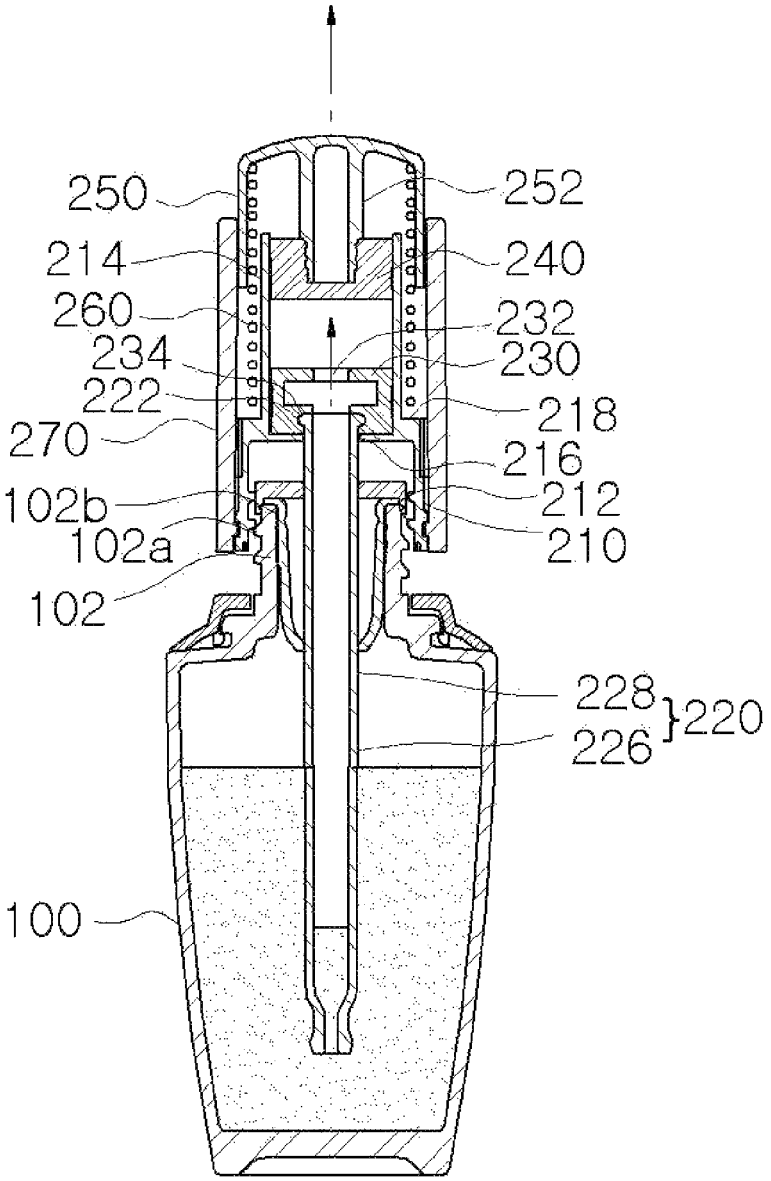

In addition, if the user more additionally presses down the pressing member 250, the pressing member 250 compresses the elastic member 260 while pressing down the upper piston 240 and the lower piston as shown in FIG. 5D, so that the lower piston 230 descends to the bottom surface of the cylinder 214.

In this case, the air layer formed at the lower portion of the lower piston 230 shown in FIG. 5C is discharged through the through hole 216 of the coupling member 210.

Accordingly, as shown in FIG. 5D, after the lower piston 230 descends to the bottom surface of the cylinder 214, the force to press the pressing member 250 is released. In this case, as shown in FIG. 5E, the pressing member 250 and the upper piston 240 ascend by the elastic restoring force of the elastic member 260 while the contents are sucked into the spuit tube 220.

Therefore, the user separates the spuit tube 220 from the insertion hole 282*b* by lifting up the spuit tube 220 after grasping the cover member 270, and presses down the pressing member 250 again so that the contents are discharged from the inner part of the spuit tube 220 and used.

In the fourth embodiment, the spuit tube 220 is press-fitted into the insertion hole 282*a* by the second stop protrusion 224 in the state that only the second stop protrusion 224 is formed on the outer portion of the spuit. Accordingly, the description of the operation in the fourth embodiment will be substituted with the description of the operation in the fifth embodiment.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A cap for a vessel of cosmetics, comprising:

a coupling member which is formed on an inner circumferential surface thereof with a female screw part engaged with a male screw part formed on an outer circumferential surface of an opening formed in an upper portion of the vessel that receives liquid-phase contents;

a spuit tube which is coupled to the coupling member to suck and discharge the contents received in the vessel; and a pumping unit of the spuit tube, which sucks the contents into the spuit tube after inserting the spuit tube into the vessel in a state that internal air of the spuit tube is partially discharged, wherein the pumping unit of the spuit tube includes:

a cylinder which has an open upper portion and protrudes from an upper end of the coupling member;

a through hole which allows the cylinder to vertically communicate with a lower portion having the female screw part;

a lower piston which is inserted into the cylinder such that that an outer circumferential surface of the lower piston closely makes contact with an inner circumferential surface of the cylinder, and has a coupling hole vertically formed therein and a coupling groove formed around a lower inner circumferential surface thereof such that a coupling protrusion from an upper end of the spuit tube, which passes through the through hole upward, is inserted into the coupling groove;

an upper piston which is spaced apart from the lower piston by a predetermined distance and inserted into the cylinder such that an outer circumferential surface of the upper piston closely makes contact with the inner circumferential surface of the cylinder;

a pressing member which is inserted into an outer portion of an upper end of the cylinder and has a coupling part formed on a bottom surface thereof and coupled to an upper end of the upper piston;

an elastic member which is inserted into an outer portion of the cylinder to be securely mounted on a mounting part formed in one of the upper end of the coupling member and a lower outer portion of the cylinder, and elastically supports a lower portion of the pressing member to apply elastic force upward;

a cover member which is down-inserted into an outer portion of the pressing member to be coupled to an outer circumferential surface of the coupling member, and has a narrower upper portion and a wider lower portion to prevent the pressing member and the elastic member from being separating from the cover member; and a stop maintaining member for the spuit tube, which temporarily stops the spuit tube down-inserted into the opening of the vessel, and maintains the spuit tube in a stopped state.

2. The cap of claim 1, wherein the stop maintaining member of the spuit tube includes a stopper which is coupled to an upper end of the vessel, and formed therein with a stop hole such that the spuit tube is down-inserted into the stop hole in a press-fitting manner.

3. The cap of claim 1, wherein the stop maintaining member of the spuit tube includes a stopper which is coupled to an upper end of the vessel, and formed therein with a stop hole having a wider upper portion and a narrower lower portion such that the spuit tube is down-inserted into the stop hole in a press-fitting manner.

4. The cap of claim 1, wherein the stop maintaining member of the spuit tube includes: a stopper which is coupled to an upper end of the vessel, and formed therein with an insertion hole such that the spuit tube is inserted into the insertion hole; and at least one first stop protrusion protruding from an inner circumferential surface of the insertion hole such that the spuit tube is down-inserted in a press-fitting manner.

5. The cap of claim 1, wherein the stop maintaining member of the spuit tube includes: a stopper which is coupled to an upper end of the vessel, and formed therein with an insertion hole such that the spuit tube is inserted into the insertion hole; and at least one second stop protrusion protruding from an outer circumferential surface of the spuit tube such that the spuit tube is down-inserted into the insertion hole in a press-fitting manner.

6. The cap of claim 1, wherein the stop maintaining member for the spuit tube includes a stopper which is coupled to an upper end of the vessel, and formed therein with a stop hole such that the spuit tube is inserted into the stop hole, and wherein an outer portion of the spuit tube is formed in multiple steps such that the spuit tube is down-inserted into an insertion hole in a press-fitting manner, an insertion part is formed to a predetermined distance of a lower portion of the spuit tube and has an outer diameter smaller than a diameter of the insertion hole, and a fitting part is formed above the insertion part such that the fitting part is press-fitted into the insertion hole.

* * * * *